US010434351B1

(12) United States Patent
Addison

(10) Patent No.: US 10,434,351 B1
(45) Date of Patent: Oct. 8, 2019

(54) MULTI-USE FITNESS AND REHABILITATION MACHINE

(71) Applicant: Raymond Addison, Orange Park, FL (US)

(72) Inventor: Raymond Addison, Orange Park, FL (US)

( * ) Notice: Subject to any disclaimer, the term of this patent is extended or adjusted under 35 U.S.C. 154(b) by 83 days.

(21) Appl. No.: 15/946,742

(22) Filed: Apr. 6, 2018

(51) Int. Cl.

| | |
|---|---|
| ***A63B 21/00*** | (2006.01) |
| ***A61H 15/00*** | (2006.01) |
| ***A63B 23/02*** | (2006.01) |
| ***A63B 23/04*** | (2006.01) |
| ***A63B 23/12*** | (2006.01) |

(52) U.S. Cl.
CPC ..... *A63B 21/00178* (2013.01); *A61H 15/00* (2013.01); *A63B 21/4035* (2015.10); *A63B 21/4039* (2015.10); *A63B 23/02* (2013.01); *A63B 23/04* (2013.01); *A63B 23/12* (2013.01); *A61H 2201/1269* (2013.01); *A61H 2201/50* (2013.01); *A63B 2225/10* (2013.01)

(58) Field of Classification Search
CPC ..... A61H 15/00; A63B 2225/10
See application file for complete search history.

(56) References Cited

U.S. PATENT DOCUMENTS 4,306,715 A * 12/1981 Sutherland ..... A63B 71/0036 482/104
4,795,149 A * 1/1989 Pearson ..... A63B 21/078 482/133
4,807,272 A * 2/1989 Guenther ..... A61B 6/14 248/125.1
4,934,693 A * 6/1990 Santoro ..... A63B 21/078 482/104
5,050,868 A * 9/1991 Pearson ..... A63B 21/0615 482/104
5,215,510 A * 6/1993 Baran ..... A63B 21/078 482/104
5,314,394 A * 5/1994 Ronan ..... A63B 21/0626 482/104
5,558,607 A * 9/1996 Darling ..... A63B 23/0488 482/907
5,669,859 A * 9/1997 Liggett ..... A63B 21/078 482/101
5,688,216 A * 11/1997 Mauriello ..... A63B 21/154 482/101
5,725,459 A * 3/1998 Rexach ..... A63B 21/0628 482/102
6,264,589 B1 * 7/2001 Chen ..... A63B 21/00 482/139
6,685,600 B1 * 2/2004 Ullman ..... A63B 21/156 482/100

(Continued)

*Primary Examiner* — Garrett K Atkinson
(74) *Attorney, Agent, or Firm* — Lawrence J. Gibney, Jr.

(57) ABSTRACT

It is important to allow a sore or injured muscle to recover after strenuous physical activity or trauma to an affected limb. The device has separate stations that permit all major muscle groups to be massaged or rehabilitated and each station can be operated independently of each other section. The individual sections can be detached from a triangular support member and placed at more ideal locations in the rehabilitation facility, if needed or desired. The device is not intended to replace the expertise of a trained medical provider or personal trainer but is intended to allow a person to self-direct some efforts to massage aching or sore muscles.

7 Claims, 8 Drawing Sheets

(56) References Cited

U.S. PATENT DOCUMENTS

| | | | | |
|---|---|---|---|---|
| 8,328,698 | B1 * | 12/2012 | Webber | A63B 21/078 482/104 |
| 9,067,102 | B2 * | 6/2015 | Poppinga | A63B 21/078 |
| 9,656,116 | B2 * | 5/2017 | Giannelli | A63B 21/063 |
| 10,272,286 | B2 * | 4/2019 | Liao Lai | A63B 22/04 |
| 2010/0128840 | A1 * | 5/2010 | Cha | A61B 6/14 378/4 |
| 2012/0316478 | A1 * | 12/2012 | Inada | A61H 7/007 601/126 |
| 2013/0040787 | A1 * | 2/2013 | Giannelli | A63B 21/062 482/97 |
| 2013/0065736 | A1 * | 3/2013 | Chen | A63B 21/068 482/96 |
| 2013/0245510 | A1 * | 9/2013 | Zaborowski | A61H 1/0237 601/33 |
| 2014/0011645 | A1 * | 1/2014 | Johnson | A63B 21/0552 482/121 |
| 2015/0065318 | A1 * | 3/2015 | Lagree | A63B 21/055 482/130 |
| 2016/0236025 | A1 * | 8/2016 | Henan | A63B 21/02 |
| 2016/0346590 | A1 * | 12/2016 | Giannelli | A63B 21/063 |
| 2017/0182351 | A1 * | 6/2017 | Scarborough | A63B 21/078 |
| 2017/0266480 | A1 * | 9/2017 | Bruni | A63B 21/062 |
| 2017/0290728 | A1 * | 10/2017 | Kose | A63B 21/00181 |
| 2017/0319158 | A1 * | 11/2017 | Ahn | A61B 6/00 |
| 2019/0009129 | A1 * | 1/2019 | Liao Lai | A63B 22/04 |
| 2019/0038930 | A1 * | 2/2019 | Sugihara | A61H 1/0274 |
| 2019/0070449 | A1 * | 3/2019 | Naidus | A63B 21/0628 |

* cited by examiner

MULTI-USE FITNESS AND REHABILITATION MACHINE

PRIOR ART

There are multiple prior art references to exercise devices and devices that rehabilitate sore or injured muscles.

A representative example of this type of device that is specifically designed to rehabilitate back muscles can be found at LaFond, U.S. Pat. No. 6,632,160. In this reference the person is seated and moves an exercise apparatus along a person's back. This device only accomplishes the rehabilitation of one group of muscle areas. Another example that teaches the exercises muscles that support the spine can be found at Carlson, U.S. Pat. No. 7,104,926; this reference primarily focuses attention on the neck muscles.

Other exercise devices such as Hale, U.S. Pat. No. 7,311,644 and Lindquist, U.S. Pat. No. 5,772,614 target different areas of the body but none of the prior art teach a device that can rehabilitate multiple areas of the body in one device.

BRIEF SUMMARY OF THE INVENTION

This device will enable the user to massage different muscle groups, which have been stressed due to either an injury, strenuous physical activity or in need of palliative treatment. It has been determined that rolling out or massaging the muscle accelerates the recovery time for a muscle or group of muscles that have been strained.

One of the difficulties of the prior methods to massage different muscle groups is due to the lack of adequate usable equipment. Typically, a person would roll on a solid hard plastic roller on the gym floor to massage out a back or leg. Not only was this cumbersome it often was distracting to others in the gymnasium or rehabilitation center because of the space that was required.

This device is a machine that will incorporate three separate machines. Each of the machines can be separated and used independently but can also be used as one unit. The use of three machines using one space is to conserve space, but the machines can be detached easily and placed in separate locations, if needed.

The device will consist of three separate stations: a chest and arm station, a leg and arm station and arm and shoulder station. Depending of the particular need of the person the person can either rehabilitate the back by standing on a platform and rotating a roller or solid hard plastic ball across the person's back using a pair of handles that will guide the roller or solid hard plastic ball for that purpose. A chest plate in the front would maintain the person's position and force the person to remain in place as the back of the person is massaged. Another station allows for the legs and arms of a person to be rehabilitated. In this station the person would place his or her leg or arm on a plate and the person would guide a roller over the affected area. The third area would be for the shoulders and arms to be rehabilitated.

A plurality of massage elements, such as a solid hard plastic roller or solid hard plastic ball, will be placed at ideal locations so the person can self-direct the rehabilitation of the muscle using a solid hard plastic roller which will either go over the person's back and shoulders or arm or leg; the solid hard plastic roller may be replaced by a solid hard plastic ball or other device to massage the muscles. In this manner, the individual can self-direct his or her rehabilitation wherein the device will be used for both rehabilitating sore muscles or massaging muscles after sports events.

DETAILED DESCRIPTION OF THE DRAWINGS

Figure 1:
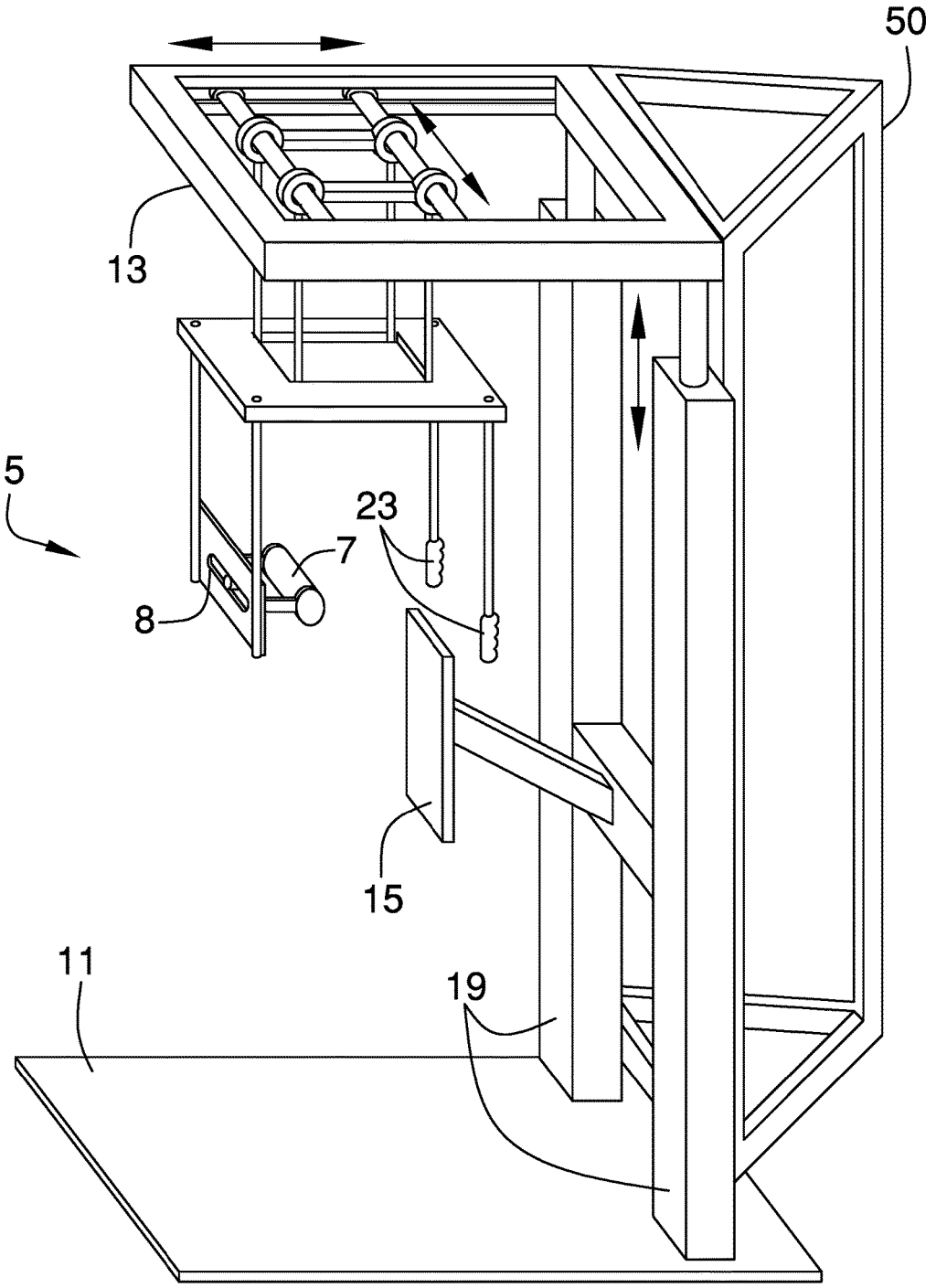
FIG. 1 is an isometric view of the chest and back station
Figure 2:
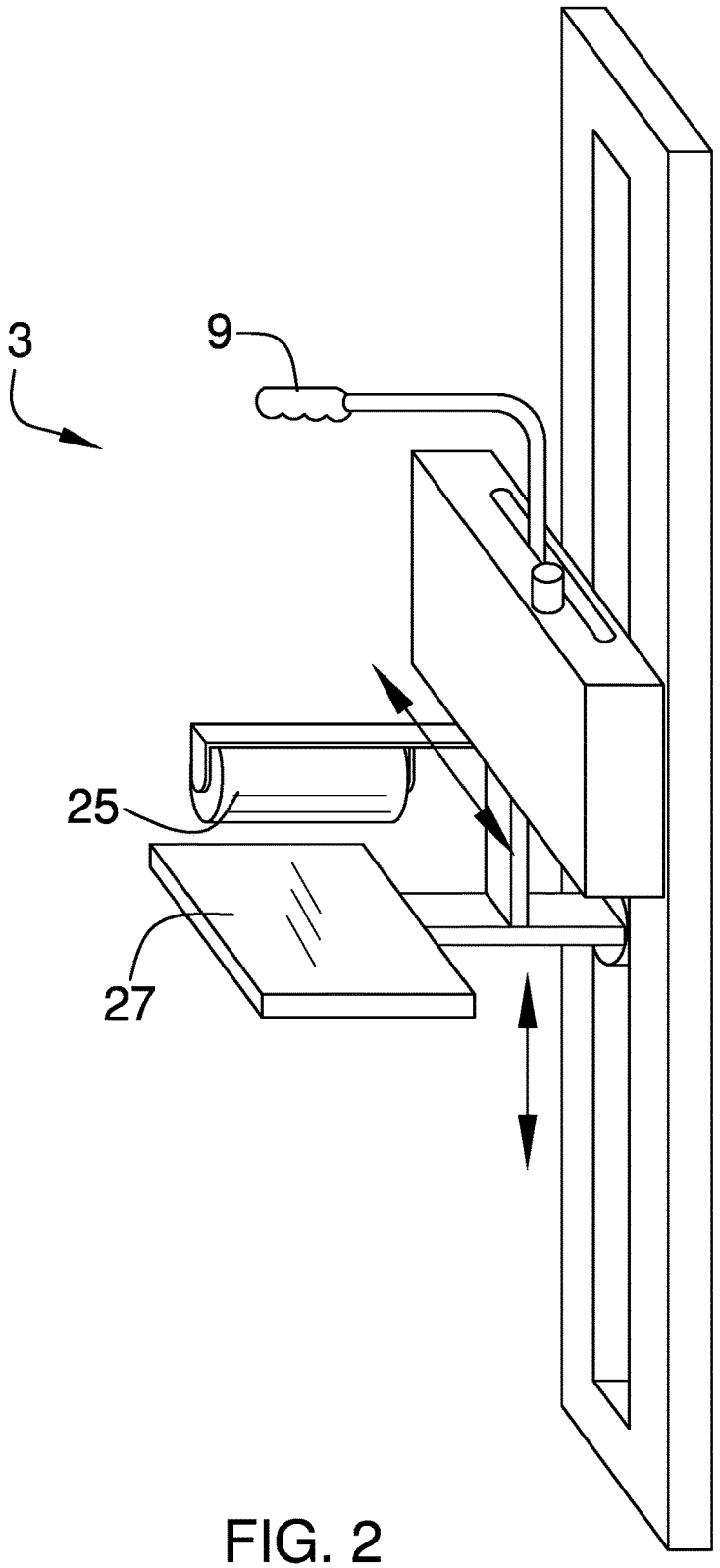
FIG. 2 is an isometric view of the leg and arm station
Figure 3:
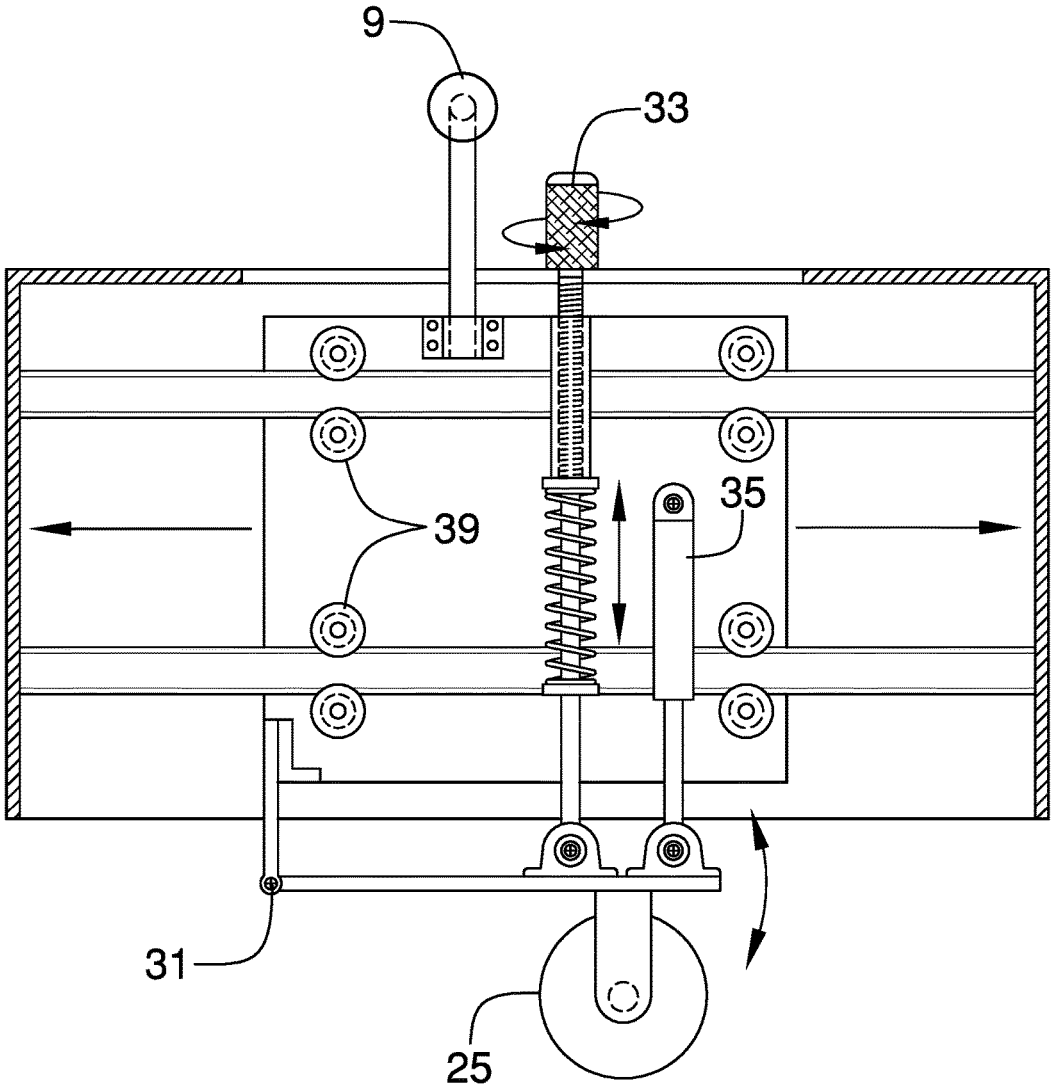
FIG. 3 is an interior view of the leg and arm station
Figure 4:
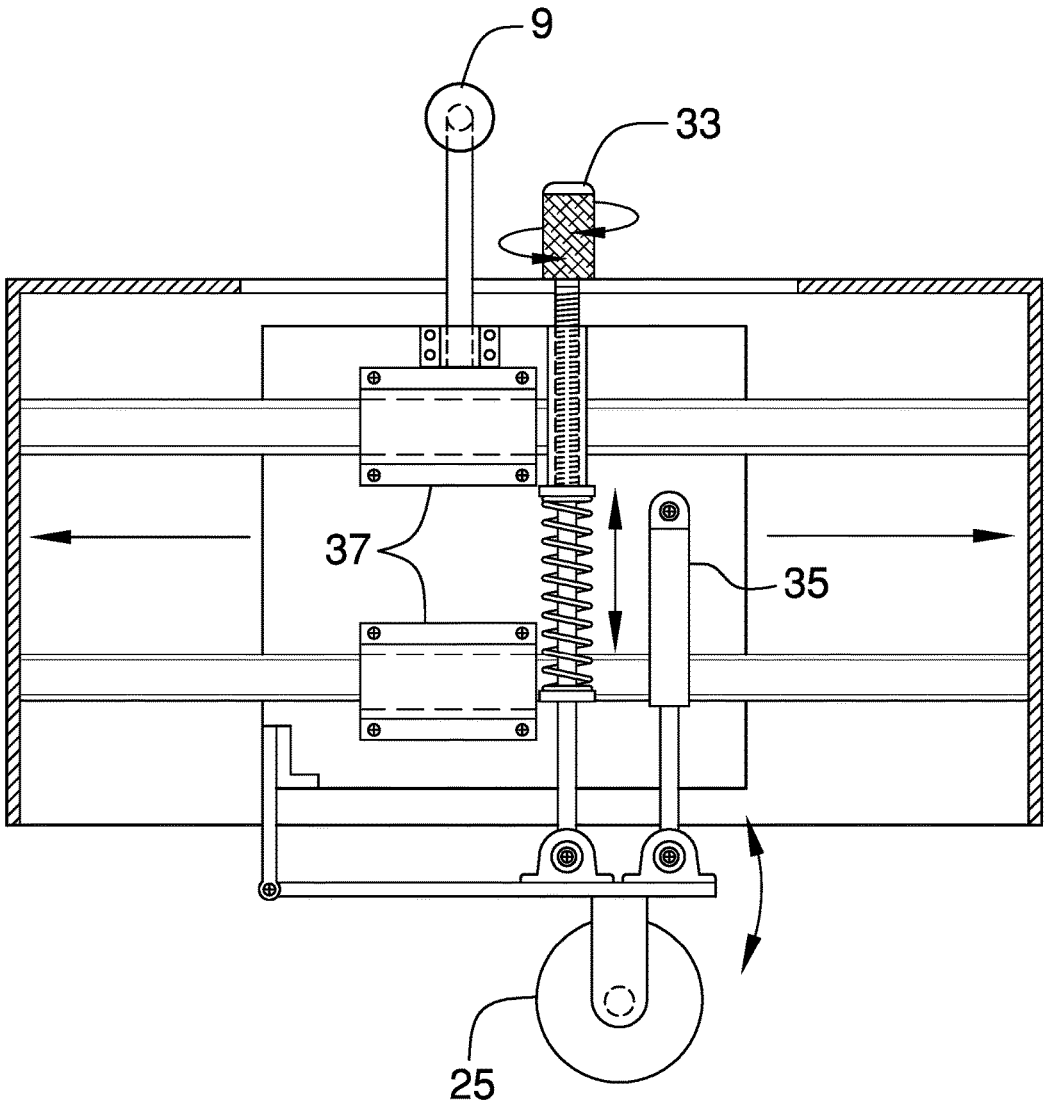
Figure 5:
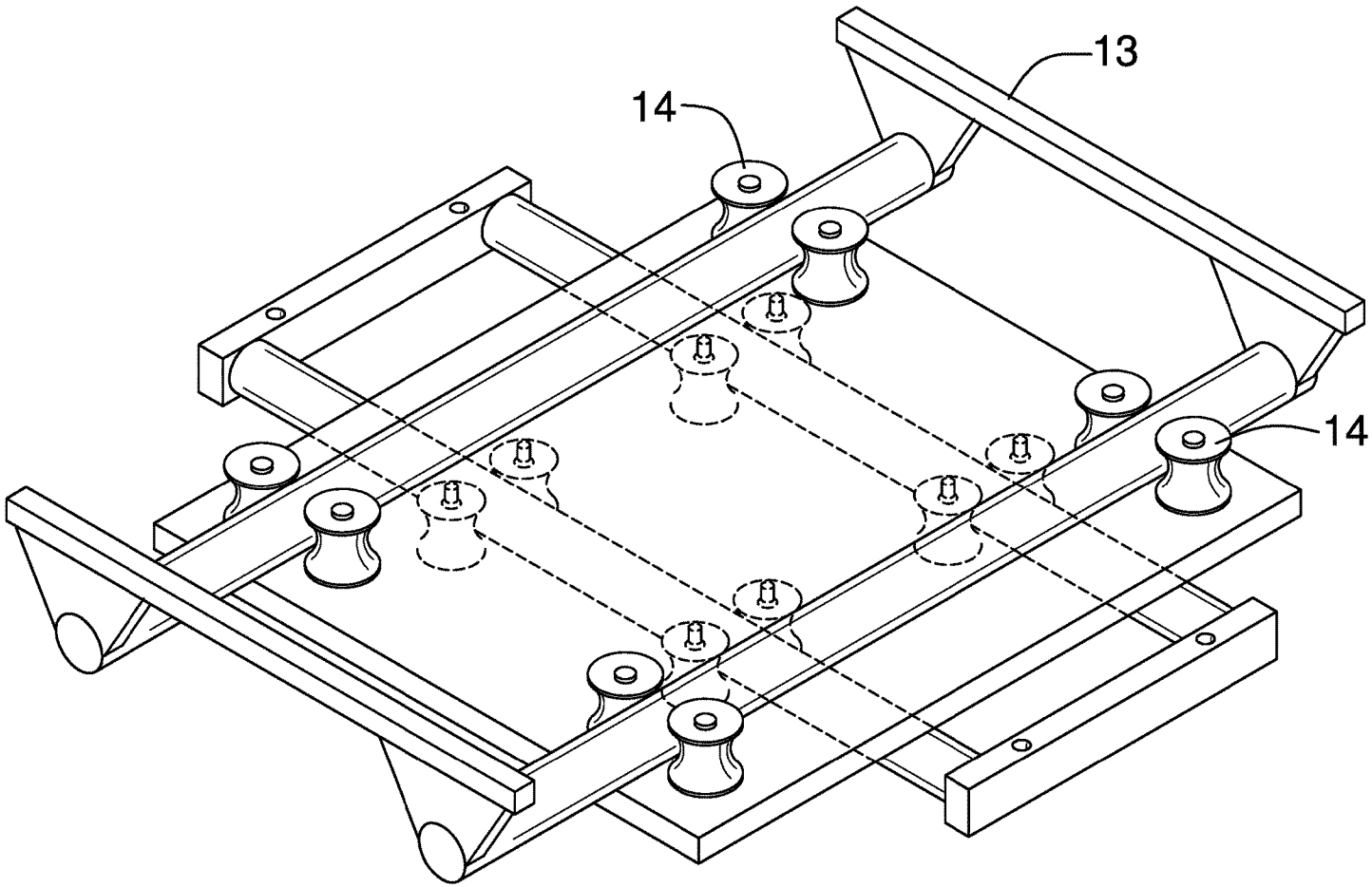
Figure 6:
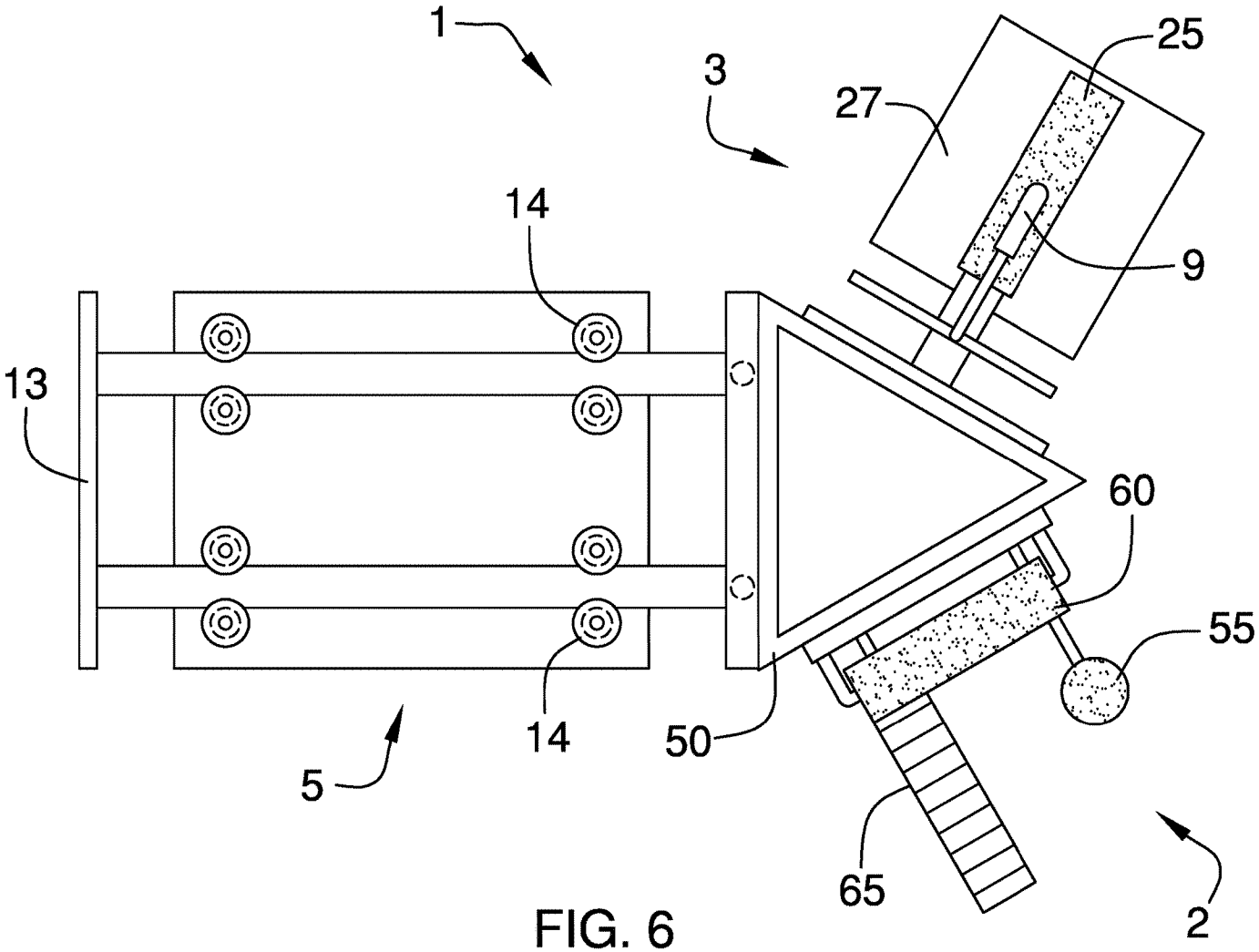
Figure 7:
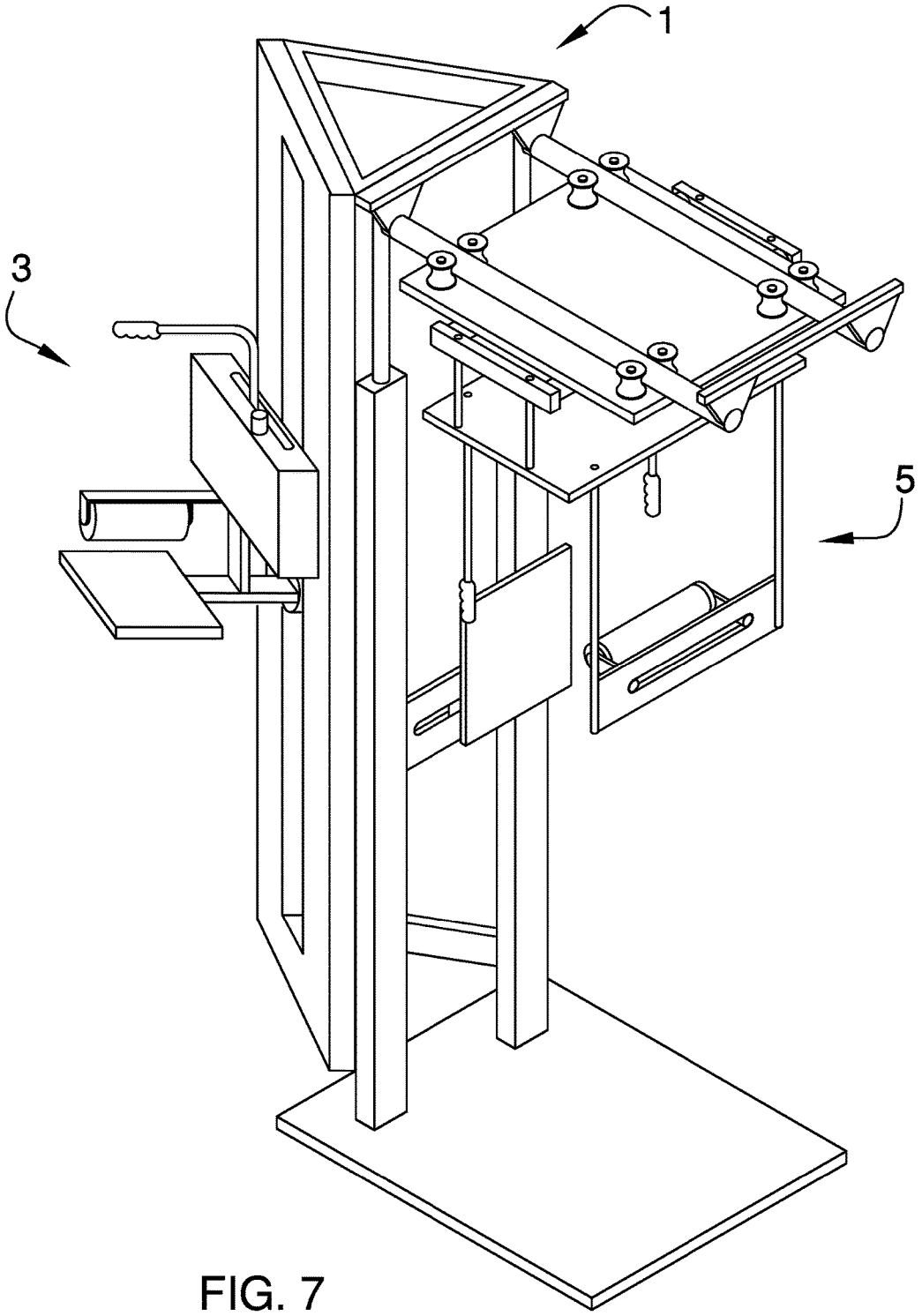
Figure 8:
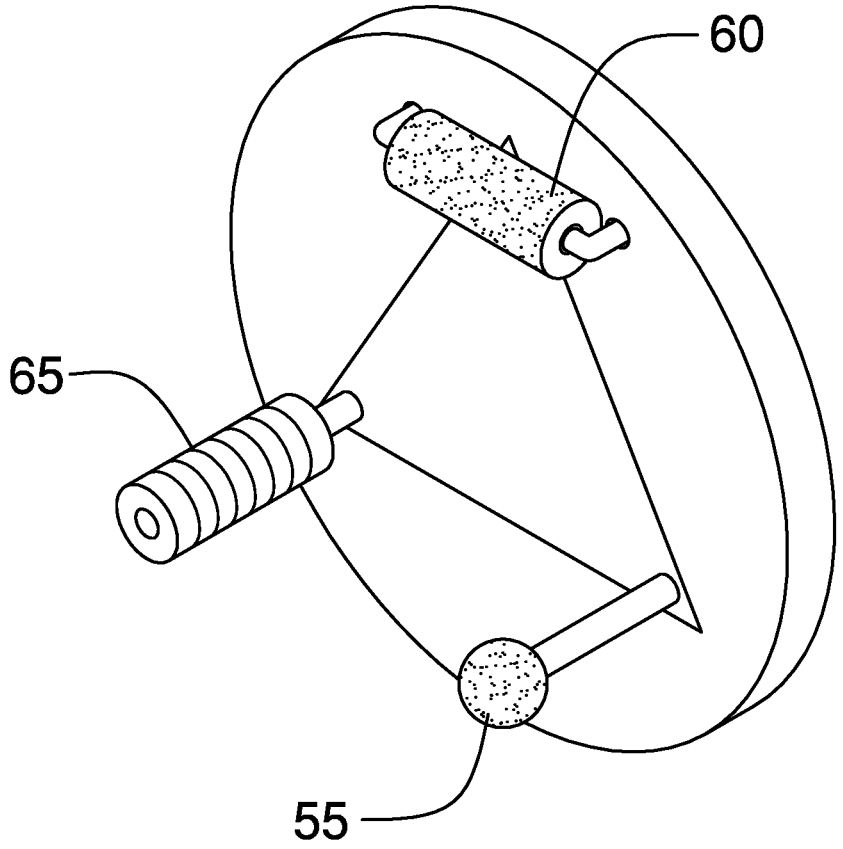

FIG. 4 is a side view of the leg and arm station depicting the use of linear bearings FIG. 5 is view of the top support structure of the chest and back station FIG. 6 is a top view of the sections of this device secured to the triangular support member FIG. 7 is an isometric view of the chest and back station and the leg and arm station secured to the triangular support member FIG. 8 is an isometric view of the multiple muscle station

NUMBERING REFERENCES

1 Device
2 Multiple muscle station
3 Leg and Arm Station
5 Chest and Back Station
6 Shoulder and Arm Station
7 Back roller
8 Back Roller Support Plate
9 Handle
11 Platform
13 Upper Support
15 Chest Plate
17 Bearings
19 Support stanchions for Chest and Back station
21 Support stanchions for Leg and Arm Station
23 Grip handles
25 Leg and Arm roller
27 Leg and arm support plate
29 Support bearing
31 Hinge
33 Tension knob
35 Gas spring
37 Bearings
39 Rollers
50 Triangular support member
51 Arm station
55 Massage element for the multiple muscle station
60 Massage element for the multiple muscle station
65 Alternative massage element for the multiple muscle station

DETAILED DESCRIPTION OF THE EMBODIMENTS

This is a 3-in-1 rehabilitation machine with Independent parts that will allow an individual to rehabilitate sore muscles; each section can be used independent of every other section that is to be rehabilitated. This device is designed to be self-directed in part by the person, although it can be used in conjunction with a trained physical therapist. This machine is not intended to replace a physical therapist or other trained medical provider.

The device has three separate stations that are attached to a triangular support member 50 and each station can be detached from the triangular support member 50 and used in different locations, if desired. The three stations are designed to rehabilitate specific muscle groups and each of the sections can be used by the individual separate from each other; the three stations are as follows: a chest and back station 5, a leg and arm station 3 and a multiple muscle station 6. Every section can be attached to a triangular support member 50 or can be mounted separately at different locations if desired. On each of the sections is a massage element 7, which is likely to be either a solid hard plastic roller or a solid hard plastic ball although other massage elements may also be used. Regardless of the type of massage element 7 that is used in the station the selection of the massage element should be firm enough to have the desired effect without injuring the person.

Chest and Back Station

In the chest and back section, the person massages or rehabilitates back muscles from the waist to the neck. This can be used to massage out sore back or shoulder muscles. A pair of stanchions 19 supports the chest and back station; the pair of stanchions 19 are secured to the triangular support member 50 but the chest and back station can be removed from the triangular support member 50 if desired or needed. In use, the person stands on a platform 11 and presses his or her body against a chest plate 15; the chest plate insures that the person remains in the same place during the activity. The distance of the chest plate can be adjusted to accommodate different sized individuals. The person would then grab a pair of grip handles 23 that will allow the solid hard plastic roller to move across a person's back, either up and down or side to side. A solid hard plastic roller 7 or solid hard plastic ball will press against the person's back and the solid hard plastic roller or solid hard plastic ball will press against the person's back. The grip handles are part of an upper support that will move laterally as well as horizontally or vertically as the person's muscles are massaged.

Support stanchions allows the support structure 13 to move the roller on the chest and back station to move from side to side.

Leg and Arm Station

The second station is a leg and arm station 3. In the leg and arm station, the person would place his or her leg or arm between the leg and arm roller 25 and a leg and/or arm support plate 27. The person uses the grip handle 23 and move the solid hard plastic roller over the affected area arm or leg. This leg and arm exercise component would also move up and down and side to side depending on the particular body shape and size of the individual being affected. The person can rehabilitate or massage an arm muscle or a leg muscle by draping the arm or leg between the leg and support plate 27 and the roller 25. The plate may also tilt to accommodate the flexibility of a person.

In the leg and arm station the solid hard plastic roller is hinged to further accommodate the surface of the person to prevent further injury as the solid hard plastic roller is pressed against the limb of the person. A tension knob 33, which is attached to a gas spring 35, allows the person or trained medical provider or personal trainer to adjust the tension of the solid hard plastic roller as it impacts the person's limb. Either the arm, from wrist to shoulder or leg from ankle to upper thigh can be massaged at this station.

Multiple Muscle Group Station

The third station 6 is used to rehabilitate multiple muscles or groups of muscles. The third station can be rotated on the triangular element to position the appropriate massage element 55, 60, 65 in place to address the specific area of concern. For instance, if the shoulder area needs to rehabilitated, this station can be rotated and locked in place so that the appropriate massage element 60 can be locked in place at the correct height for that individual. Once in position the person can then place the massage element 60 on the affected muscle group to rehabilitate the muscle group. The other massage elements 55, 65 on the shoulder and arm station are used to rehabilitate a person's forearm muscles or leg muscles for instance by rolling the affected muscle group over the appropriate solid hard plastic roller. Like the other sections this section can be detached from the triangular element and used independently of each of the other stations. The height of the third station can be adjusted according to the needs of the user. On that same station the station can be rotated to position the massage element in the appropriate position to massage the arm of leg for example.

The invention claimed is:

1. A multi-use fitness and rehabilitation machine that is comprised of a triangular support member;

a chest and back station;

wherein the chest and back station can be attached to the triangular support member;

wherein a chest plate is provided;

wherein an upper support is provided;

wherein a pair of grip handles are provided;

said grip handles are connected to the upper support;

wherein the upper support moves from side to side;

wherein the upper support moves up and down;

wherein a platform is provided on the chest and back station;

wherein a massage element is provided in the chest and back station;

wherein the massage element moves as the person moves the grip handles;

a leg and arm station;

wherein a plate is provided;

said plate is tiltable;

said plate can be locked in place;

a multiple muscle station;

wherein the multiple muscle station is rotatable;

wherein the height of the multiple muscle station is adjustable;

wherein the multiple muscle station can be locked in place;

said multiple muscle station can be locked in place on the triangular support element;

wherein a plurality of massage elements are provided.

2. The multi-use fitness and rehabilitation machine as described in claim 1 wherein the massage element is a solid hard plastic roller.

3. The multi-use fitness and rehabilitation machine as described in claim 1 wherein the massage element is a solid hard plastic ball.

4. The multi-use fitness and rehabilitation machine as described in claim 1 wherein the chest and back station can be removed from the triangular support member.

5. The multi-use fitness and rehabilitation machine as described in claim 1 wherein the leg and arm station can be removed from the triangular support member.

6. The multi-use fitness and rehabilitation machine as described in claim 1 wherein the multiple muscle station can be removed from the triangular support member.

7. The multi-use fitness and rehabilitation machine as described in claim 1 wherein the tension of the roller in the leg and arm station can be adjusted.

* * * * *